US011342149B2

(12) United States Patent
Despont

(10) Patent No.: US 11,342,149 B2
(45) Date of Patent: May 24, 2022

(54) INTEGRATED ELECTRO-MECHANICAL ACTUATOR

(71) Applicant: International Business Machines Corporation, Armonk, NY (US)

(72) Inventor: Michel Despont, Cheseaux-Noreaz (CH)

(73) Assignee: International Business Machines Corporation, Armonk, NY (US)

( * ) Notice: Subject to any disclaimer, the term of this patent is extended or adjusted under 35 U.S.C. 154(b) by 704 days.

(21) Appl. No.: 16/131,750

(22) Filed: Sep. 14, 2018

(65) Prior Publication Data

US 2019/0027331 A1 Jan. 24, 2019

Related U.S. Application Data

(60) Division of application No. 13/732,832, filed on Jan. 2, 2013, now Pat. No. 10,079,128, which is a continuation of application No. 13/638,275, filed as application No. PCT/IB2011/051322 on Mar. 29, 2011, now Pat. No. 9,029,719.

(30) Foreign Application Priority Data

Mar. 30, 2010 (EP) ..... 10158391

(51) Int. Cl.
*H01H 49/00* (2006.01)
*H01H 59/00* (2006.01)

(52) U.S. Cl.
CPC ..... *H01H 49/00* (2013.01); *H01H 59/00* (2013.01); *H01H 59/0009* (2013.01)

(58) Field of Classification Search
CPC ..... H01H 59/00; H01H 59/0009
See application file for complete search history.

(56) References Cited

U.S. PATENT DOCUMENTS 5,024,500 A 6/1991 Stanley et al.
6,058,027 A 5/2000 Vargha et al.
6,153,839 A 11/2000 Zavracky et al.
(Continued)

FOREIGN PATENT DOCUMENTS

CN 1233343 A 10/1999
CN 1346503 A 4/2002
DE 19935678 A1 2/2001

OTHER PUBLICATIONS

International Search Report—PCT/IB2011/051322.
(Continued)

*Primary Examiner* — Livius R. Cazan
(74) *Attorney, Agent, or Firm* — Scully, Scott, Murphy & Presser, PC; Vazken Alexanian, Esq.

(57) ABSTRACT

The present invention provides an integrated electro-mechanical actuator and a manufacturing method for manufacturing such an integrated electro-mechanical actuator. The integrated electro-mechanical actuator comprises an electrostatic actuator gap between actuator electrodes and an electrical contact gap between contact electrodes. An inclination with an inclination angle is provided between the actuator electrodes and the contact electrodes. The thickness of this electrical contact gap is equal to the thickness of a sacrificial layer which is etched away in a manufacturing process.

17 Claims, 5 Drawing Sheets

(56) References Cited

U.S. PATENT DOCUMENTS

| | | | | |
|---|---|---|---|---|
| 6,433,657 | B1 | 8/2002 | Chen | |
| 2003/0102936 | A1* | 6/2003 | Schaefer | H01H 59/0009 333/105 |
| 2007/0029584 | A1* | 2/2007 | Valenzuela | G11C 23/00 257/254 |
| 2007/0229199 | A1 | 10/2007 | Weller et al. | |

OTHER PUBLICATIONS

"Young's Modulus", https://en.wikipedia.org/wiki/Young%27s_modulus, Dec. 29, 2009 version.

* cited by examiner

INTEGRATED ELECTRO-MECHANICAL ACTUATOR

CROSS-REFERENCE TO RELATED APPLICATIONS

The present application is a divisional application of and claims the benefit of the filing date of U.S. patent application Ser. No. 13/732,832, filed Jan. 2, 2013, which is a continuation application of U.S. patent application Ser. No. 13/638,275, filed on Sep. 28, 2012, now U.S. Pat. No. 9,029,713, issued May 12, 2015.

BACKGROUND

The present disclosure relates to an integrated electro-mechanical actuator and to a method for manufacturing such an integrated electro-mechanical actuator.

TECHNICAL BACKGROUND

As power and energy constraints in microelectronic applications become more and more challenging one is seeking constantly alternative and more power efficient ways of switching and computing. A typical switching device used in the semi-conductor industry is a CMOS transistor. To overcome power related bottle necks in CMOS devices novel switching devices operate on fundamentally different transport mechanisms such as tunnelling are investigated. However, combining the desirable characteristics of high on-current, very low off current, abrupt switching, high speed as well as a small footprint in a device that might be easily interfaced to a CMOS device is a challenging task. Mechanical switches such as Nano-Electro-Mechanical switches (NEM Switches) are promising devices to meet these kinds of criteria. A Nano-Electro-Mechanical switch having a narrow gap between electrodes is controlled by electrostatic actuation. In response to an electrostatic force a contact electrode can be bent to contact another electrode thus closing a switch. The control of the narrow gap for the electrostatic actuation and for the electrical contact separation is a main issue in designing and operating Nano-Electro-Mechanical switches. The NEM Switch has to meet both the requirement of high switching speed and low actuation voltage. Typically to achieve an actuation voltage in the range of 1 V and a switching speed approaching 1 ns the provided gap between the electrodes has to be in the range of about 10 nm. However to define and control the dimension of a 10 nm spacing between electrodes is difficult even when applying state of the art lithography technology.

SUMMARY OF THE INVENTION

The invention provides an integrated electro-mechanical actuator comprising an electrostatic actuator gap between actuator electrodes, an electrical contact gap between contact electrodes, wherein an inclination with an inclination angle is provided between said actuator electrodes and said contact electrodes.

In a possible embodiment of the integrated electro-mechanical actuator according to the present invention, a thickness of said electrical contact gap is equal to the thickness $g_0$ of a sacrificial layer.

In a possible embodiment of the integrated electro-mechanical actuator according to the present invention, the gap $g_A$ of said electrostatic actuator gap depends on the thickness of said electrical contact gap and said inclination angle $\alpha$ as follows:

$$g_A = g_0 \cdot \cos(\alpha).$$

In a possible embodiment of the integrated electro-mechanical actuator according to the present invention, the electro-mechanical actuator is an in-plane actuator.

In a further possible embodiment of the integrated electro-mechanical actuator according to the present invention, the electro-mechanical actuator is an out-of-plane actuator.

In a further possible embodiment of the integrated electro-mechanical actuator according to the present invention said electro-mechanical actuator is a vertical actuator.

In a possible embodiment of the integrated electro-mechanical actuator according to the present invention the thickness of the contact gap is in a range of 5-50 nm.

In a possible embodiment of the integrated electro-mechanical actuator according to the present invention said inclination angle is in a range of 15-60 degrees.

In a possible embodiment of the integrated electro-mechanical actuator according to the present invention the electro-mechanical actuator comprises at least one electro-mechanical switch.

In an embodiment of the integrated electro-mechanical actuator according to the present invention in an actuated switching state of the electro-mechanical switch the contact gap is closed and in a not actuated switching state of the electro-mechanical switch the contact gap is not closed.

In an embodiment of the integrated electro-mechanical actuator according to the present invention in the actuated switching state of the electro-mechanical switch a structured contact beam fixed to a contact electrode is bent or moved in response to an electrostatic force generated by an electrical field between the structured contact beam and an actuator electrode.

In a possible embodiment of the integrated electro-mechanical actuator according to the present invention the structured contact beam comprises a flexible portion fixed to the contact electrode and a rigid portion connected to the flexible portion and having at its distal end an electrical contact surface separated by the electrical contact gap from an electrical contact surface of another contact electrode.

In an embodiment of the integrated electro-mechanical actuator according to the present invention the flexible portion of the structured contact beam comprises a spring constant in the range of 0.1 to 10 N/m.

In a possible embodiment of the integrated electro-mechanical actuator according to the present invention the electro-mechanical actuator comprises an input electrode for applying an input voltage, an output electrode for providing an output voltage, a first supply voltage electrode to which a first structured contact beam is fixed, a second supply voltage electrode to which a second structured contact beam is fixed, wherein if the input voltage applied to the input electrode corresponds to the first supply voltage the second structured contact beam fixed to the second supply voltage electrode is bent or moved in response to an electrostatic force generated by an electrical field between the second structured contact beam and the input electrode to provide a contact between the second supply voltage electrode and the output electrode, wherein if the input voltage supplied to the input electrode corresponds to the second supply voltage the first structured contact beam fixed to the first supply voltage electrode is bent or moved in response to an electrostatic force generated by an electrical field between the first structured contact beam and the input electrode to provide a contact between the first supply voltage electrode and the output electrode.

The invention further provides a method for manufacturing an integrated electro-mechanical actuator comprising
an electrostatic actuator gap between actuator electrodes,
an electrical contact gap between contact electrodes,
wherein an inclination with an inclination angle is provided between said actuator electrodes and said contact electrodes,
wherein each gaps are formed by etching a single sacrificial layer having a thickness corresponding to said electrical gap.

In a possible embodiment of the method for manufacturing an integrated electro-mechanical actuator according to the present invention, the sacrificial layer is formed by atomic layer deposition (ALD).

In an alternative embodiment of the method for manufacturing an integrated electro-mechanical actuator according to the present invention, the sacrificial layer is formed by chemical vapour deposition (CVD).

In a still further embodiment of the method for manufacturing an integrated electro-mechanical actuator according to the present invention, the sacrificial layer is formed by plasma enhanced chemical vapor deposition (PECVD).

In a possible embodiment of the method for manufacturing an integrated electro-mechanical actuator according to the present invention, the method comprises the steps of:
etching silicon on insulator to provide beam bodies,
performing a selective silicidation of said beam bodies,
deposition of a sacrificial layers on said beam bodies,
performing a metal deposition,
performing a CMP, and
etching the sacrificial layers and said insulator to separate the beam bodies from a substrate.

BRIEF DESCRIPTION OF THE FIGURES

In the following possible embodiments of an integrated electro-mechanical actuator and of a method for manufacturing such an integrated electro-mechanical actuator are described with reference to the enclosed figures.

DETAILED DESCRIPTION OF EMBODIMENTS

Figure 1A:
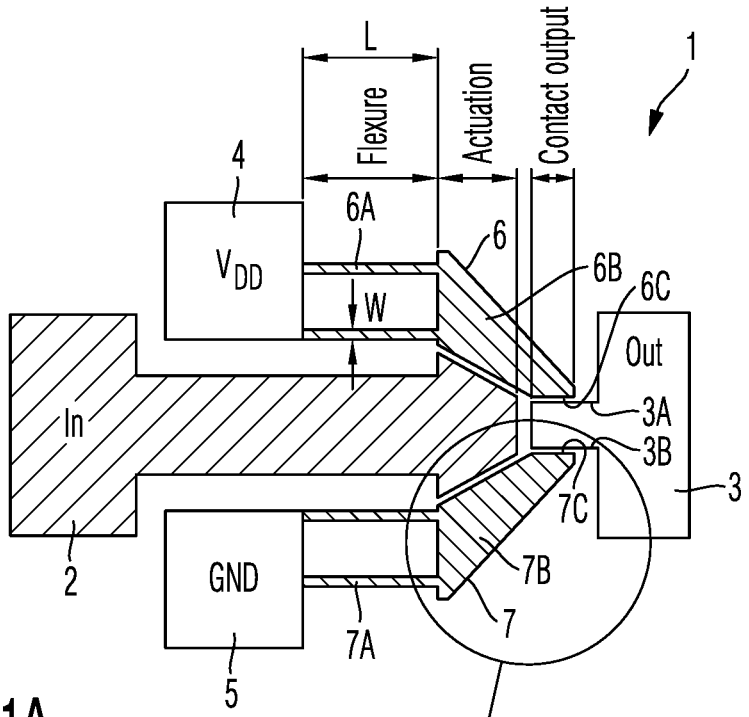
FIG. 1A, 1B, 1C show a possible embodiment of an integrated electro-mechanical actuator according to the present invention.

As can be seen from FIG. 1A which shows a first possible embodiment of an integrated electro-mechanical actuator 1 the electro-mechanical actuator 1 comprises actuator electrodes and contact electrodes. The embodiment shown in FIG. 1A is an in-plane actuator and in particular an in-plane electro-mechanical switching device. The in plane topology shown in FIG. 1A is the topology of a NEM switch which can be provided on a substrate. FIG. 1A is a top view showing the switch topology from above. In the shown embodiment the electro-mechanical actuator 1 being a switching device comprises an input electrode 2 for applying an input voltage. The electro-mechanical actuator 1 further comprises an output electrode 3 for providing an output voltage. Furthermore, a first supply voltage electrode 4 is provided to which a first supply voltage $V_1$ (e.g. VDD) can be applied. The electro-mechanical actuator 1 further comprises a second supply voltage electrode 5 to which a second supply voltage $V_2$ (e.g. GND) can be applied. As can be seen in FIG. 1A a first structured contact beam 6 is fixed to the first supply voltage electrode 4. In the same manner a second structured contact beam 7 is fixed to the second supply voltage electrode 5. As can be seen from FIG. 1A the integrated electro-mechanical actuator 1 as shown in FIG. 1 comprises a symmetrical structure. The electro-mechanical actuator 1 comprises in the shown embodiment two structured contact beams 6, 7. Each structured contact beam 6, 7 comprises a flexible portion and a rigid portion. In the shown embodiment of FIG. 1A the structured contact beam 6 comprises a flexible portion 6A fixed to the first contact electrode 4. The structured contact beam 6 further comprises a rigid portion 6B having at its distal end an electrical contact surface 6C separated by an electrical contact gap from an electrical contact surface 3A of the output electrode 3. The second structured contact beam 7 also comprises a flexible portion 7A fixed to the second supply voltage electrode 5 and a rigid portion 7B connected to the flexible portion 7A having at its distal end an electrical contact surface 7C separated by an electrical contact gap from an electrical contact surface 3B of the output electrode 3. Both structured contact beams 6, 7 of a flexible portion 6A, 7A can comprise a predetermined spring constant in a range of 0.1 to 10 N/m. In the embodiment shown in FIG. 1A each flexible portion 6A, 7A of a structured contact beam 6, 7 comprises two structured bars running in parallel to each other in a predetermined width w and a height h. In a possible embodiment an aspect ratio between the width w and the height h of the two parallel flexible bars which can be bent by electrostatic forces is between 1:1 and 1:5.

In the embodiment shown in FIG. 1A if the input voltage $V_{in}$ applied to the input electrode 2 corresponds to the first supply voltage $V_1$ (e.g. VDD) the second structured contact beam 7 fixed to the second supply voltage electrode 5 is bent or moved in response to an electrostatic force provided by an electrical field between the second structured contact beam 7 and the input electrode 2 to provide a contact between a second supply voltage electrode 5 and the output electrode 3.

Figure 1B:
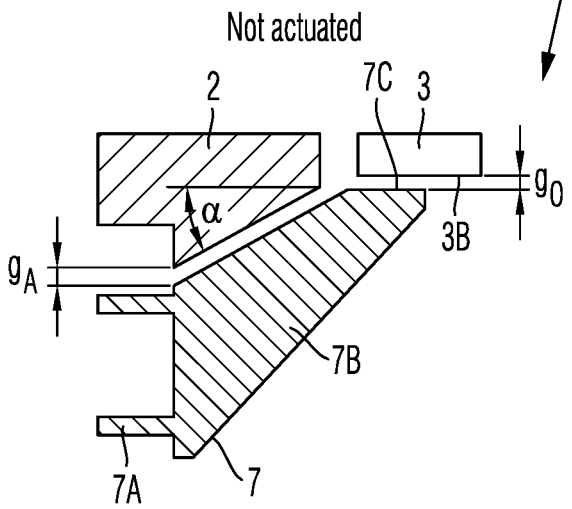

FIG. 1B shows the second structured contact beam 7 of the actuator 1 in a not actuated state where no voltage signal is applied to the input electrode 2. As can be seen from FIG. 1B in the not-actuated state an electrical contact gap having a thickness $g_0$ is provided between the contact surface 7C of the second structured contact beam 7 and the contact surface 3B of the output electrode 3. Furthermore, an electrostatic actuator gap having a distance of $g_A$ between the input electrode 2 and the rigid portion 7B of the second structured contact beam 7 is provided. As can be seen from FIG. 1B in the not actuated state an electrostatic actuator gap with a thickness $g_0$ is provided between the second structured contact beam 7 fixed to the second supply voltage electrode 5 and an electrostatic actuator gap having a distance $g_A$ is provided between the electrode 2 and the second structured contact beam 7 fixed to the second supply voltage electrode 5. As can be seen from FIG. 1B an inclination with an inclination angle α is provided between the electrostatic actuator gap and the electrical contact gap.

Figure 1C:
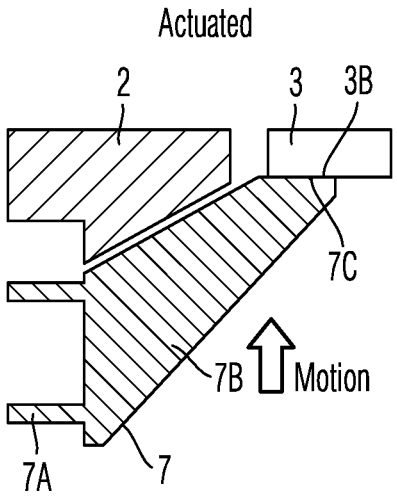

FIG. 1C shows an actuated state after switching the second supply voltage electrode 5 to the output electrode 3. As can be seen from FIG. 1C the electrical contact gap between the second structured contact beam 7 fixed to the second supply voltage electrode 5 has been closed after actuation so that the electrical contact surface 7C at the distal end of the rigid portion 7B of the second structured contact beam 7 contacts the contact surface 3B of the output electrode 3. The electrostatic actuator gap between the input electrode 2 and the rigid portion 7B of the second structured contact beam 7 is not closed even after actuation as can be seen in FIG. 1C. When applying an input voltage $V_{in}$ corresponding to the first supply voltage $V_1$ (e.g. VDD) to the input electrode 2 an electrostatic field is provided between the input electrode 2 and the second supply voltage electrode 5 to which a second supply voltage $V_2$ (e.g. GND) is applied and to which the second structured contact beam 7 is fixed. In particular the electrostatic field between the rigid portion 7B of the second structured contact beam 7 and the input electrode 2 over the narrow actuator gap causes this flexible portion 7A to be bent or to be moved towards the input electrode 2 without closing the actuator gap between the input electrode 2 and the second structured contact beam 7 but closing the contact gap between the rigid portion 7B and the output electrode 3 thus switching the second supply voltage electrode 5 to the output electrode 3.

If the input voltage supplied to the input electrode 2 correspond to the second supply voltage $V_2$ (e.g. GND) the first structured contact beam 6 fixed to the first supply voltage electrode 4 is bent or moved in response to an electrostatic force generated by an electrical field between the first structured contact beam 6 and the input electrode 2 to provide a contact between the first supply voltage electrode 4 and the output electrode 3. Accordingly, the embodiment shown in FIG. 1A comprises an integrated electro-mechanical actuator 1 having two switches and operating like a voltage inverter. If the input voltage $V_{in}$ applied to the input electrode 2 is a high input voltage corresponding to the first high supply voltage VDD the output electrode 3 provides a low output voltage $V_{in}$ (e.g. GND). Contrary if the input voltage applied to the input electrode 2 is low and corresponds to the second low supply voltage (GND) applied to the second supply voltage electrode 5 the second supply voltage electrode 4 is contacted with the output electrode 3 which provides high output voltage at the output.

Both gaps, i.e. the actuator gap $g_A$ and the contact gap $g_0$ are gaps between electrodes measured in a motion direction. The difference between the electrode angles of the contact and the actuator electrode is α. The gap $g_A$ of the electrostatic actuator gap depends on the thickness of the electrical contact gap $g_0$ and on the inclination angle α as follows:

$$g_A = g_0 \cdot \cos(\alpha)$$

By choosing the predetermined inclination angle α the motion gap difference can be provided by design.

In a preferred embodiment the thickness $g_0$ of the electrical contact gap is equal to the thickness of a sacrificial layer in the manufacturing process. In a possible embodiment the thickness of the contact gap $g_0$ is in a range of 5 to 50 nm. In a preferred embodiment the thickness $g_0$ of the contact gap is in a range of 5 to 15 nm preferably about 10 nm.

In a possible embodiment the inclination angle α between the actuator electrodes and the contact electrodes is in a range of 15 to 60 degrees. In a preferred embodiment the inclination angle α is in a range between 25 and 35 degrees in particular about 30 degrees.

The parallel bars of the flexible portions 6A, 7A of the structured beams 6, 7, can comprise an aspect ratio of about 1 to 2 such that they perform no rotational but only a translational motion when actuated. In a possible embodiment the thickness $g_0$ of the electrical contact gap is about 10 nm and the inclination angle α has 30 degrees so that the thickness $g_A$ of the electrostatic actuator gap is about 11.5 nm so that there is a slight difference of about 1.5 nm between the gap $g_0$ of the electrical contact gap and the gap $g_A$ of the electrostatic actuator gap. Such a slight difference would very hard to create by conventional lithography methods. The integrated electromechanical actuator 1 according to the present invention having an inclination angle between the actuator electrodes and the contact electrodes allows to define a different gap with the same spacer. In a possible embodiment the input electrode 2 and the output electrode 3 are formed by Platinum electrodes. Depending on a length L of the flexible beam portion 6A, 7A it is possible to adjust a spring constant for the structured contact beams 6, 7 which can vary in a range of 0.1 to 10 N/m. By increasing the length of the flexible portion the structured contact beam are easier to be bent or moved by electrostatic forces. Accordingly, by increasing the length L of the flexible portion the necessary switching voltages can be reduced. In a possible embodiment the switching voltages are in a range between 0.5 and 5 V. In a preferred embodiment the switching voltages are in a range lower than 1 V. Accordingly, the actuation voltage for performing an actuation, in particular a switching, is less than 1 V in a preferred embodiment.

Figure 2A:
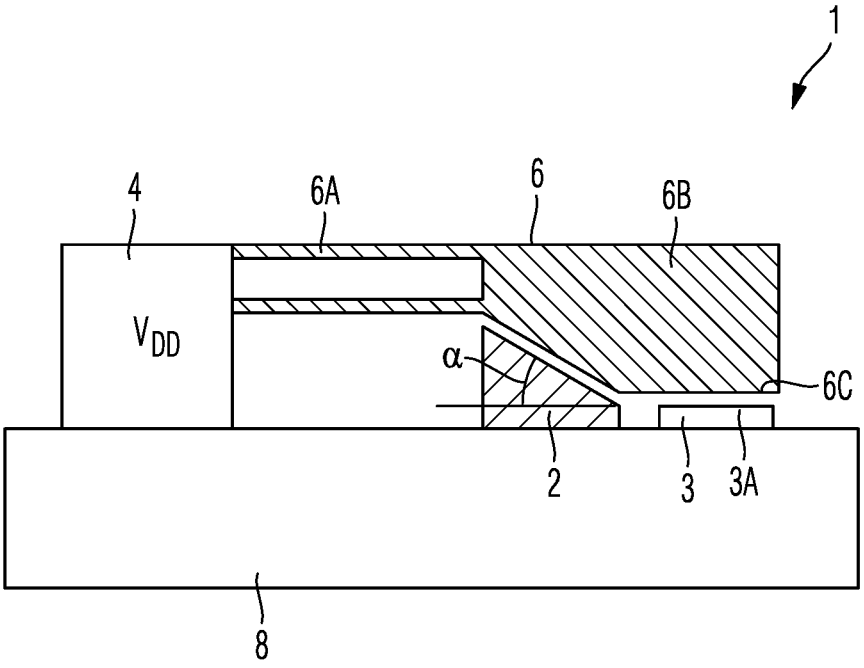
FIG. 2A, 2B show a further embodiment of an integrated electro-mechanical actuator according to the present invention.
Figure 2B:
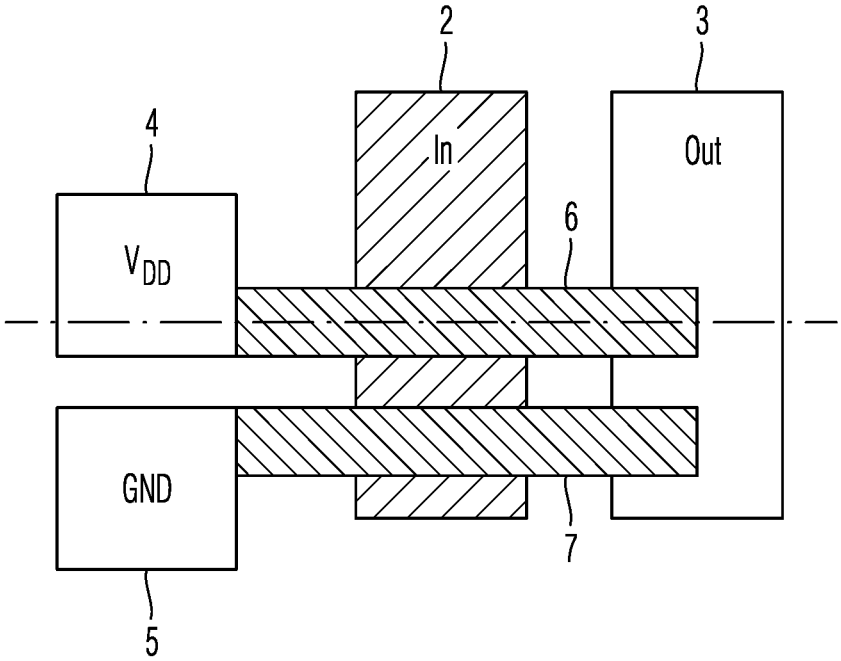

FIG. 2A shows a side view on a further possible embodiment of an integrated electro-mechanical actuator 1 according to the present invention. FIG. 2A shows a side view whereas FIG. 2B shows a top view on the embodiment. The embodiment shown in FIGS. 2A, 2B is an out-of-plane embodiment of the electro-mechanical actuator 1. As can be seen from FIGS. 2A, 2B two supply voltage electrodes 4, 5 can be placed on a substrate 8 and to each supply voltage electrode 4, 5 a structured beam portion 6, 7 is fixed and can be actuated depending on a voltage applied to the input electrode 2. If the input voltage $V_{in}$ applied to the input electrode 2 corresponds to a low voltage (GND) applied to a second apply voltage electrode 5 the electrostatic field between the flexible portion of the structured contact beam 6 bents or moves the beam towards the output electrode 3 until a contact surface 6C of the structured contact beam 6 contacts the contact surface 3A of the output electrode 3. The embodiment of FIG. 2A, 2B is an out-of-plane electro-mechanical actuator 1 where the structured contact beams 6, 7 also comprise a flexible portion and a rigid portion. There is an inclination with an inclination angle α provided between the actuator electrodes and the contact electrodes. The structure of the structured contact beams 6, 7 provides a translational motion under the influence of the electrostatic field but no rotational motion. FIG. 2A shows a not-actuated switching state of an electro-mechanical switch in which the contact gap is not closed. In an actuated switching state of the electro-mechanical switch, shown in FIG. 2A, the contact gap between surfaces 3A, 6C is closed. In the actuated switching state of the electro-mechanical switch the structured contact beam 6 fixed to the contact electrode 4 is bent or moved in response to an electrostatic force generated by an electrical field between the structured contact beam 6 and the actuator electrode which is formed in this case by the input electrode 2. By bending the structured contact beam 6 the electrical contact gap $g_0$ between the contact electrodes is closed but the electrostatic actuator gap is only closed partially leaving a remaining gap thus avoiding contact.

Figure 3:
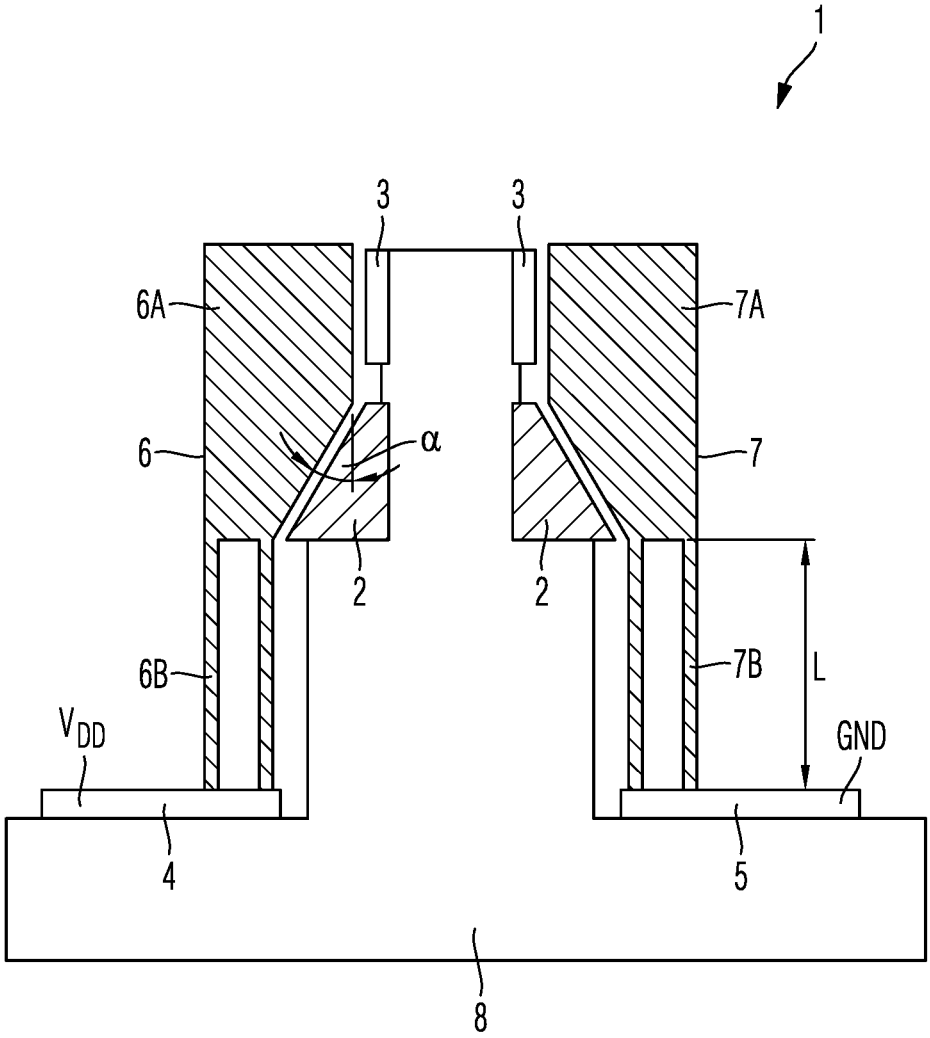
FIG. 3 shows a side view on a further embodiment of an integrated electro-mechanical actuator according to the present invention.

FIG. 3 shows a further possible embodiment of an integrated electro-mechanical actuator 1 according to the present invention. In the embodiment of FIG. 3 the integrated electro-mechanical actuator 1 is a vertical actuator. As can be seen in FIG. 3 the integrated electro-mechanical actuator 1 is provided on a substrate 8 having two vertical structured contact beams 6, 7 fixed to a first supply voltage electrode 4 and a second supply voltage electrode 5. Both structured electro-mechanical contact beams 6, 7 comprise a rigid portion 6A, 7A and a flexible portion 6B, 7C. If the input voltage $V_{in}$ applied to the input electrode 2 corresponds to the first supply voltage $V_1$ (e.g. VDD) applied to the electrode 4 the second structured contact beam 7 fixed to the second supply voltage electrode 5 having e.g. a low potential GND is bent or moved in response to an electrostatic force generated by the electrical field between the second structured contact beam 7 and the input electrode 2 to provide a contact between the second supply voltage electrode 5 and the output electrode 3. By contrast, if the input voltage $V_{in}$ applied to the input electrode 2 corresponds to the second low supply voltage (GND) the first structured contact beam 6 fixed to the first supply voltage electrode 4 is moved in response to the electrostatic force generated by an electrical field between the first structured contact beam 6 and the input electrode 2 to provide a contact between the first supply voltage electrode 4 and the output electrode 3. By adjusting the length L of the flexible portions 6B, 7B it is possible to adjust a spring constant in a range of e.g. 0.1 to 10 N/m.

Figure 4:
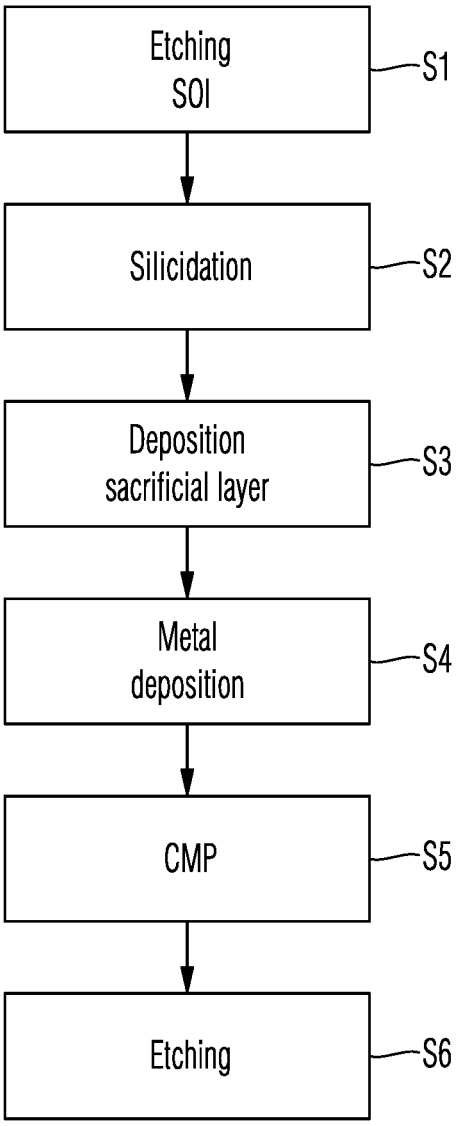
FIG. 4 shows a flowchart for illustrating a possible embodiment of a method for manufacturing an integrated electro-mechanical actuator according to the present invention.
Figure 5A:
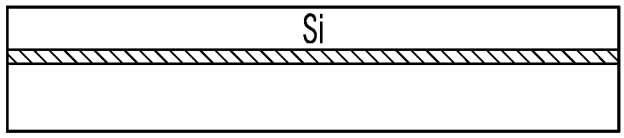
FIGS. 5A-G illustrate a manufacturing step in a possible embodiment of a method for manufacturing an integrated electro-mechanical actuator according to the present invention.
Figure 5B:
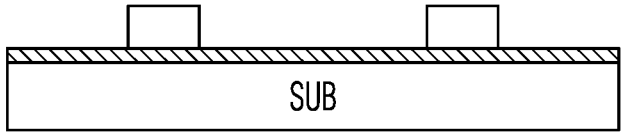
Figure 5C:
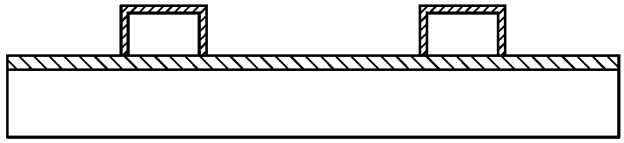
Figure 5D:
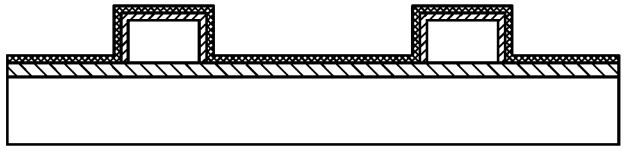
Figure 5E:
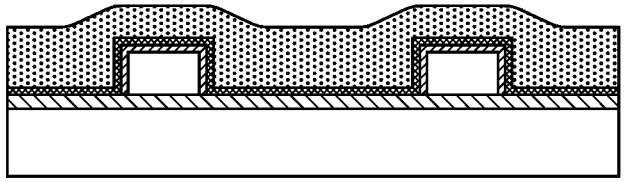
Figure 5F:
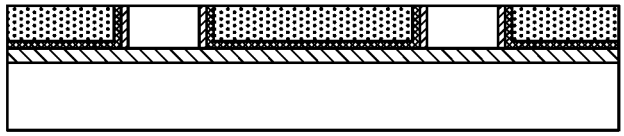
Figure 5G:
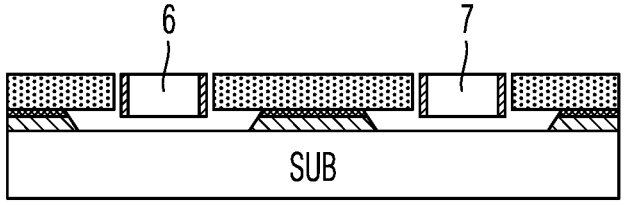

FIG. 4 as well as FIGS. 5A, 5G illustrate a possible embodiment of a method for manufacturing an integrated electro-mechanical actuator 1 according to the present invention.

In a first step S1 of the manufacturing process a silicon on insulator (SOI) is etched to provide beam bodies. As can be seen in FIG. 5A silicon is separated from a substrate by an insulator such as an oxide in particular SIO2. To provide the beam bodies a membrane etching is performed as shown in FIG. 5B.

In a further step S2 a selective silicidation is performed as shown in FIG. 5C. On the beam bodies a metal layer is deposited and selectively forming a silicide with silicon, The remaining metal being etched away. Metal can be platinum (Pt) forming a PtSi silicide. A layer is applied which is conductive but does not oxidize.

In a further step S3 sacrificial layer is deposited on the beam bodies as shown also in FIG. 5D. In a possible embodiment the sacrificial layer is formed by atomic layer deposition ALD. The thickness of the sacrificial layer corresponds in a preferred embodiment to the defined gap of the electro-mechanical actuator 1 which can be in a range of 5 to 50 nm preferably about 10 nm. In a possible embodiment the sacrificial layer formed by the atomic layer deposition ALD is $Al_2O_3$. In alternative embodiments of sacrificial layer can also be formed by chemical vapor deposition CVD or by Plasma enhanced chemical vapor deposition.

In a further step S4 a metal deposition is performed as also shown in FIG. 5E. A metal such as Platinum (Pt) is deposited on the structure.

In a further step S5*a* CMP step, i.e. a mechanical polition step is performed as shown in FIG. 5F to get a flat surface.

Finally, in a step S6 the sacrificial layer deposited in step S3 is etched as well as the insulator of the SOI structure to separate the beam bodies of the electro-mechanical actuator from the substrate as can be seen in FIG. 5G. In a possible embodiment this is performed by vapor HF etching. As can be seen in FIG. 5G the structured beam bodies which can form the first and second structured contact beams 6, 7 of the integrated in the electro-mechanical actuator 1 and can be actuated or moved in lateral direction to close electrode gaps.

The integrated electro-mechanical actuator 1 according to the present invention which can be manufactured by a manufacturing process as shown in FIGS. 4, 5 allows for a high on-current and a very low off-current. Further, the switching can be performed at a high switching speed. The integrated electro-mechanical actuator 1 according to the present invention provides a small footprint in a device and can be easily interfaced with other electronic devices in particular CMOS devices. Furthermore, the electro-mechanical actuator 1 according to the present invention has almost zero leakage current and steep sub-threshold slope with a mechanical delay in the order of nanoseconds. Moreover, the integrated electro-mechanical actuator 1 can be easily manufactured as demonstrated by the manufacturing process of FIGS. 4, 5. A further advantage of the electro-mechanical actuator 1 is that the design of the electro-mechanical actuator 1 can be adapted to the specific application by adjusting corresponding parameters such as a spring constant of a flexible portion of the structured contact beams 6, 7 depending inter alia from a length L of the flexible portion. The electro-mechanical actuator 1 according to the present invention can be manufactured in a manufacturing process which is relatively insensitive to a variation of sacrificial layer thickness. A sacrificial thickness variability of 10% leads to a gap difference variation of also 10% for an inclination angle $\alpha=30°$.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims. For example, the gaps are not necessary obtained by sacrificial layer. Furthermore, in embodiments, the said electrostatic actuator gap may be designed irrespective of the thickness of said electrical contact gap and said inclination angle. It may still depend on these two quantities but not necessarily according to the law $g_A=g_0\cdot\cos(\alpha)$. Also, the actuator may have configurations other than in-plane, out-of-plane or vertical. Similarly, in embodiments, the thickness of said contact gap is not necessarily in the range of 5-50 nm and the inclination angle does not necessarily need to be in the range of 15-60 degrees, depending on a particular application sought. Furthermore, the extent into which the contact gap is actually closed depends on detailed circumstances. Also, other means than a structured contact beam can be relied upon. Still, should a contact beam (or a contact part, or the like) be used, various design can be contemplated as to its exact structure. More generally, embodiments of the integrated electro-mechanical actuator according to the invention may be implemented in digital electronic circuitry or in computer hardware.

The invention claimed is:

1. A method for manufacturing an integrated electro-mechanical actuator; comprising the steps of:

providing contact electrodes and an output electrode with an electrical contact gap between the contact electrodes and the output electrode, etching a silicon on insulator (SOI) structure to provide two or more beam structures of said electro-mechanical actuator, said beam structures formed atop an insulator layer of said SOI structure;

performing a selective silicidation of said two or more beam structures, forming a sacrificial material layer on top said two or more beam structures, said sacrificial material layer having a thickness corresponding to said electrical contact gap;

performing a metal deposition on top said formed sacrificial material layer, performing a chemical-mechanical polishing (CMP) to a surface of said deposited metal to form a flattened surface, and, etching said sacrificial material layer and said insulator layer to separate said beam structures from a substrate of said SOI structure, said beam structures forming said contact electrodes, wherein said electrical contact gap is formed by said etching said sacrificial material layer having a thickness corresponding to said electrical contact gap.

2. The method as claimed in claim 1, including forming an actuator electrode between said contact electrodes such that a respective electrostatic actuator gap lies between the actuator electrode and a respective contact electrode, wherein each said respective electrostatic actuator gap is formed by said etching said sacrificial material layer having a further thickness corresponding to said electrostatic actuator gap.

3. The method as claimed in claim 2, wherein an inclination with an inclination angle is provided between said electrostatic actuator gap and said electrical contact gap.

4. The method as claimed in claim 2, further comprising:

wherein a portion of a respective contact electrode and said formed actuator electrode form an inclination defining an inclination angle $\alpha$ therebetween.

5. The method according to claim 4, wherein said electrostatic actuator gap $g_A$ of depends on the thickness of said electrical contact gap $g_0$ and said inclination angle $\alpha$ according to:

$$g_A = g_0 \cdot \cos(\alpha).$$

6. The method according to claim 5, wherein the thickness of said contact gap $g_0$ ranges between about 5-50 nm.

7. The method according to claim 6, wherein said inclination angle $\alpha$ is in a range of 15-60 degrees.

8. The method according to claim 4, wherein said electrostatic actuator gap $g_A$ depends on the thickness of said electrical contact gap $g_0$ and said inclination angle ($\alpha$) according to:

$$g_A = g_0 \cdot \cos(\alpha).$$

9. The method according to claim 2, wherein each said contact electrode has a formed flexible portion and rigid portion, wherein responsive to providing an electrical field between a contact electrode and the actuator electrode, the flexible portion moves so that the rigid contact beam portion of the contact electrode contacts said output electrode.

10. The method according to claim 9, wherein said formed flexible portion of a contact electrode comprises two structured bars running in parallel to each other that bend or move to provide a translational motion of said rigid contact beam portion.

11. The method as claimed in claim 1, wherein said sacrificial material layer is formed by atomic layer deposition (ALD).

12. The method as claimed in claim 1, wherein said sacrificial material layer is formed by chemical vapour deposition (CVD).

13. The method as claimed in claim 1, wherein said sacrificial material layer is formed by plasma enhanced chemical vapor deposition (PECVD).

14. The method according to claim 1, forming one of: an in-plane electro-mechanical actuator, an out-of-plane electro-mechanical actuator or a vertical electro-mechanical actuator.

15. A method for manufacturing an integrated electro-mechanical actuator comprising:

forming movable contact electrodes with an electrical contact gap between the contact electrodes and an immovable output electrode, forming an actuator electrode between the contact electrodes with a respective electrostatic actuator gap between the actuator electrode and a respective contact electrode, a portion of a respective contact electrode and an actuator electrode formed at an inclination defining an inclination angle $\alpha$ therebetween, wherein each said respective electrostatic actuator gap and electrical contact gap is formed by etching a sacrificial material layer having a thickness corresponding to a thickness of said electrostatic actuator gap and a further thickness corresponding to a thickness of said electrical contact gap, wherein each said movable contact electrode has a formed flexible portion and rigid portion such that responsive to providing an electrical field between a movable contact electrode and the actuator electrode, the flexible portion moves so that the rigid contact beam portion of the contact electrode contacts said output electrode, said formed flexible portion of a movable contact electrode comprising two structured bars running in parallel to each other that bend or move to provide a translational motion of said rigid contact beam portion.

16. The method of claim 15, wherein said contact electrodes are formed by:

etching a silicon on insulator (SOI) structure to provide two or more beam structures of said integrated electro-mechanical actuator, said beam structures formed atop an insulator layer of said SOI structure;

performing a selective silicidation of said two or more beam structures, forming a sacrificial material layer on top said two or more beam structures, performing a metal deposition on top said formed sacrificial material layer, performing a chemical-mechanical polishing (CMP) to a surface of said deposited metal to form a flattened surface, and, etching said sacrificial material layer and said insulator layer to separate said beam structures from a substrate of said SOI structure, said beam structures forming said contact electrodes.

17. The method according to claim 16, wherein said sacrificial material layer is formed by: atomic layer deposition (ALD), chemical vapor deposition (CVD), or by plasma enhanced chemical vapor deposition.

* * * * *